US005595073A

United States Patent [19]

Sullivan

[11] Patent Number: 5,595,073

[45] Date of Patent: Jan. 21, 1997

[54] WEATHERPROOF MULTIPLE PADLOCK CASE, COVER AND METHOD

[76] Inventor: John J. Sullivan, 270 Morgan St., South Hadley, Mass. 01075

[21] Appl. No.: 555,897

[22] Filed: Nov. 13, 1995

[51] Int. Cl.[6] ..... E05B 67/38

[52] U.S. Cl. ..... 70/18; 70/50; 70/54; 70/56; 70/58; 70/63; 70/159

[58] Field of Search ..... 70/14, 15, 18, 70/50, 51, 63, 54–56, 58, 423, 424, DIG. 43, DIG. 56, 455, 158–162

[56] References Cited

U.S. PATENT DOCUMENTS

| | | | |
|---|---|---|---|
| 4,033,156 | 7/1977 | Cottingham | 70/56 |
| 4,474,116 | 10/1984 | Castenada, Jr. et al. | 70/63 X |
| 4,573,332 | 3/1986 | Ma | 70/160 X |
| 5,181,402 | 1/1993 | Faessler et al. | 70/18 |
| 5,219,384 | 6/1993 | Elsfelder et al. | 70/54 X |
| 5,275,028 | 1/1994 | Giarrante | 70/56 |

FOREIGN PATENT DOCUMENTS

| | | | |
|---|---|---|---|
| 154804 | 10/1938 | Austria | 70/55 |
| 2334387 | 8/1977 | France | 70/18 |

*Primary Examiner*—Lloyd A. Gall
*Attorney, Agent, or Firm*—James F. Baird

[57] ABSTRACT

Method and apparatus to provide a weatherproof enclosure for one or more padlocks. The invention incorporates a weatherproof case cover and case body sized and shaped to house a plurality of padlocks together with the two looped ends of a cable that is used to secure a gate or other opening. Two donut shaped gaskets made of a resilient material are positioned on the cable in order that they make secure compressed contact with the case cover and case body when they are in a closed position. The case cover and case body are both shaped to receive the donut shaped gaskets at the points of contact and yet sufficiently compress the gaskets to form a weatherproof seal. The case cover and case body are sized and shaped in order that both have a channel at the point of contact between the case cover and case body. A gasket in two sections is positioned in the channel and is sized and shaped to be slightly compressed when the case cover and case body are in a closed position resulting in a continuation of the weatherproof seal.

2 Claims, 2 Drawing Sheets

FIG. 3
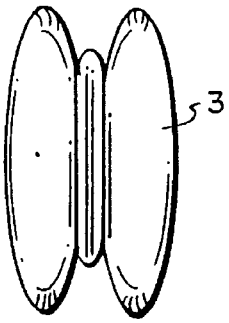
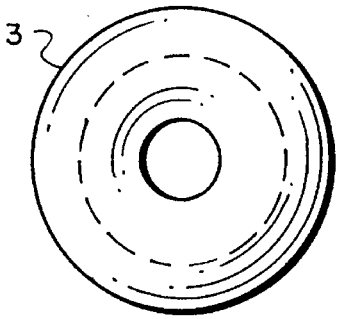
FIG. 4
FIG. 5A
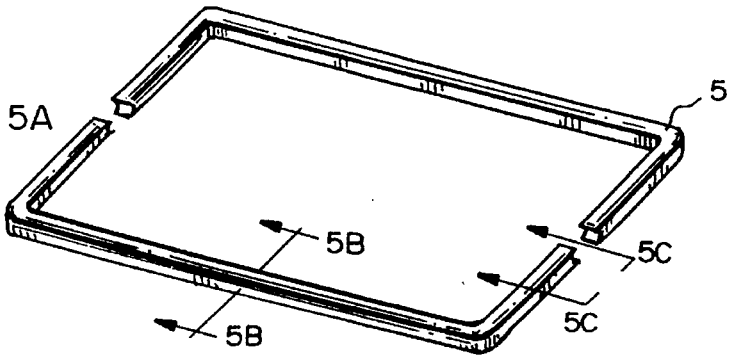
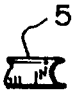
FIG. 5C
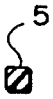
FIG. 5B
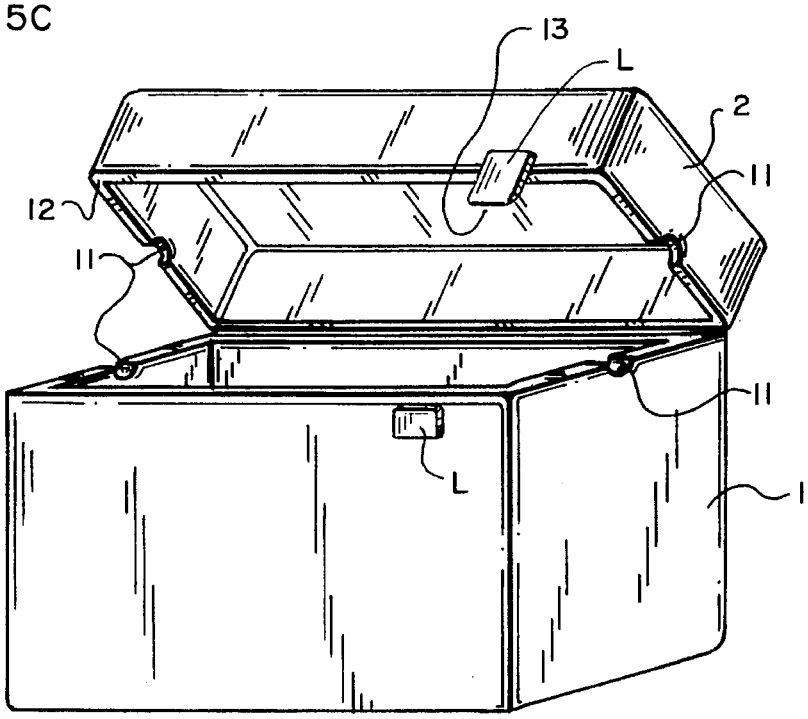
FIG. 6

WEATHERPROOF MULTIPLE PADLOCK CASE, COVER AND METHOD

BACKGROUND OF THE INVENTION

Many situations require that an outside gate or other opening be locked for safety and other reasons such as security. In many instances the locks are exposed to the weather and may freeze or corrode. One solution has been to apply heat to the lock to unfreeze or free the lock. In an emergency the time taken to free the frozen or corroded lock may be the difference between life and death. In the past this problem has been resolved in some cases by building an expensive shelter to protect the locks. Many times it is necessary to secure a gate or other opening in a remote or temporary location and due to the expense involved it is not practical to construct a shelter. One solution that attempts to resolve the problem is U.S. Pat. No. 5,275,028. U.S. Pat. No. 5,275,028 claims a padlock protector in which the container for the padlock has a moisture proof seal however, the protector may allow moisture to enter at openings where the lockable loop or hasp enters the protector. In addition the protector has a drain aperture that will allow moist air to enter thereby defeating the moisture proof seal feature. U.S. Pat. No. 5,275,028 also references several other U.S. patents and provides a detailed summary of each. None of the referenced patent summaries either separately or in combination recites the features of the invention I claim.

My invention provides a truly weatherproof padlock enclosure.

It is therefore an object of the invention to provide an apparatus and method to enclose one or more padlocks in a weatherproof case and cover.

A further object of the invention is to provide an apparatus and method to enclose one or more padlocks in a case that has a cover that may be easily opened during all types of weather.

Another object of the invention is to provide a weatherproof padlock case and cover that may be easily and economically manufactured.

Yet another object of the invention is to provide a weatherproof enclosure to house a plurality of padlocks together with a desiccant to remove any latent moisture.

With these and other objects in view, as will be apparent to those skilled in the art, the invention resides in the combination of parts set forth in the specification and covered by the claims appended hereto.

SUMMARY OF THE INVENTION

The method and apparatus disclosed in detail below is of a form that is both practical and economical to manufacture in order to promote wide use. In addition to it's preferred form, it may be made in a variety of designs, shapes and sizes.

The apparatus is a weatherproof enclosure for housing and protecting a plurality of padlocks or other security devises. The apparatus comprises a case cover, a case body, two donut shaped gaskets and an elongated gasket in two sections. The apparatus is used in combination with a plurality, of padlocks or other security devises. In addition, a flexible cable with a loop at each end or similar means is used to secure a gate or other opening. The donut shaped gaskets are positioned upon the flexible cable. The case cover and case body are sized and shaped in order that they have notched out areas to receive the donut shaped gaskets and yet cause the donut shaped gaskets to sufficiently compress to form a weatherproof seal. In addition, the case cover and case body each have a channel at the point of contact where the case cover and case body meet. A gasket of resilient material in two sections is sized and shaped to fit within the case cover and case body channels and be slightly compressed when the case cover and case body are in a closed position resulting in a continuation of the weatherproof seal. A security loop is positioned on the rear surface of the case body. The security loop is sized to permit free passage therethrough of one of the cable loops prior to securing the cable around the gate. The cable loops are then placed near enough to each other in the case body in order that one or more padlocks loops may be locked forming a series of links with the loops.

The case body is positioned with the two gasket sections placed in the case body channel and the two donut shaped gaskets that are positioned on the cable are placed in the two appropriately sized and shaped notches located in the case body. The case cover is now placed in a closed position causing the two donut shaped gaskets and the two gasket sections to be slightly compressed forming one continuous weatherproof seal.

The case cover and case body may be lined with a moisture absorbing desiccant material to remove any moisture that is trapped in the apparatus when closed. While the invention will be described in connection with a preferred embodiment, it will be understood that I do not intend to limit the invention to that embodiment. On the contrary, I intend to cover all alternatives, modifications and equivalents as may be included within the spirit and scope of the invention as defined by the appended claims.

BRIEF DESCRIPTION OF THE DRAWINGS

The object and features of the invention may be understood with reference to the following detailed description of an illustrative embodiment of the invention, taken together with the accompanying drawings in which.

The fence gate is shown for illustrative purposes.

Figure 1:
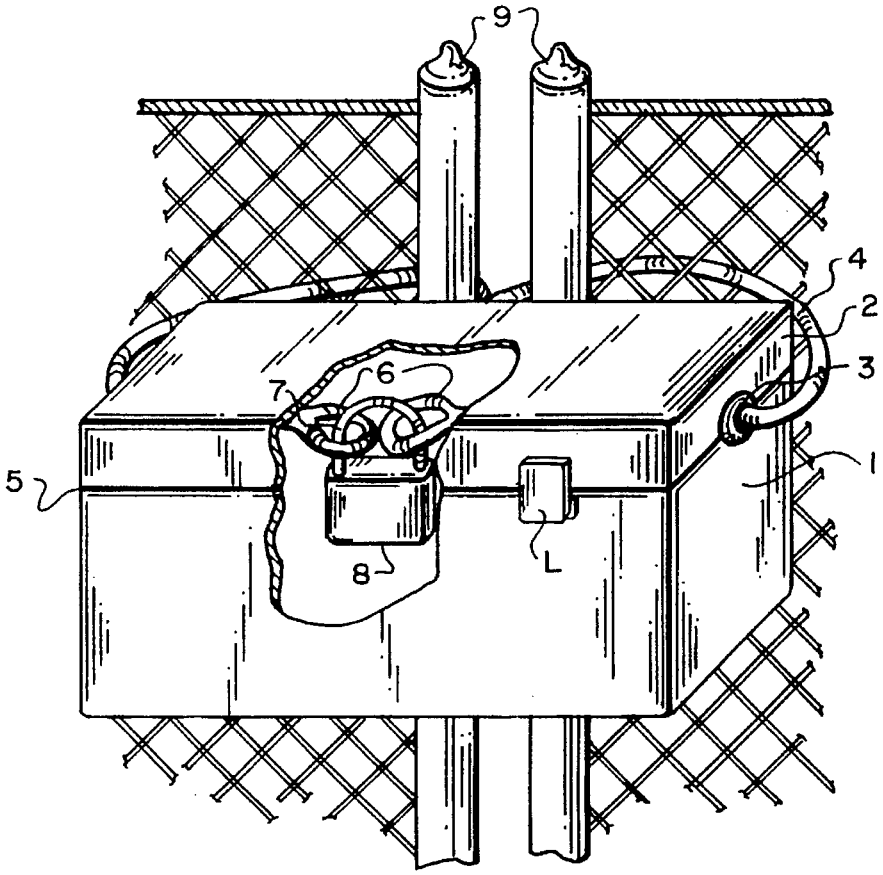
FIG. 1. illustrates a top perspective view of the apparatus indicating it's use to secure a fence gate (9). Shown are the case body (1), case cover (2), one of the donut shaped gaskets (3), cable (4) and one of the sections of the gasket (5). In addition in the cut away view, the looped cable ends (6), padlock hasp (7) and padlock (8) are revealed.
Figure 2:
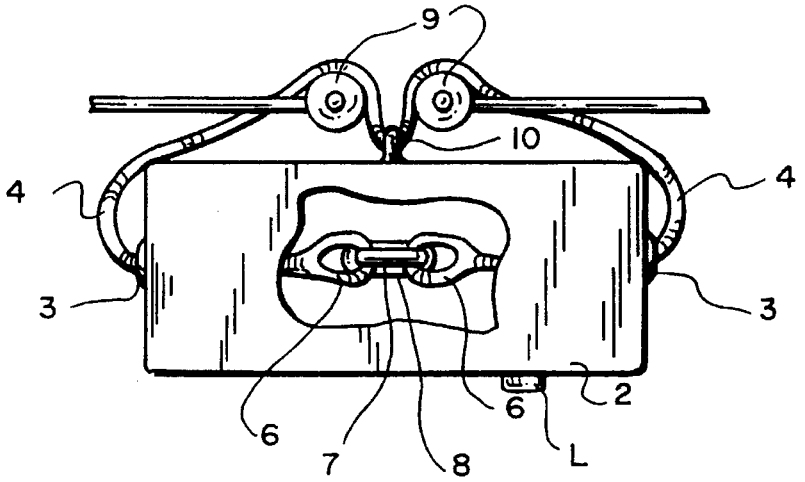

FIG. 2. illustrates a top view of the apparatus. Shown are the case cover (2), the donut shaped gaskets (3), cable (4), fence gate (9) and security loop (10). In addition, in the cut away view, the looped cable ends (6), padlock hasp (7) and padlock (8) are revealed.

FIG. 3. illustrates an end view of one of the donut shaped gaskets (3). Note the two areas of reduced diameter between a portion with a slightly increased diameter and two outer portions of even greater diameter.

FIG. 4. illustrates a side view of one of the donut shaped gaskets (3), note the outer diameter and the hole. The slightly increased diameter is indicated by spaced lines.

FIG. 5A illustrates a perspective view of the two sections of the gasket (5).

FIG. 5B illustrates a cross sectional view of one of the gaskets (5) at line 5B in view FIG. 5A.

FIG. 5C illustrates a sectional view of one of the gaskets (5) at line 5C in view FIG. 5A.

FIG. 6. illustrates a perspective view of the apparatus in an open position. Shown are the case body (1), case cover (2), semi-circular notched out areas with channels (11), channel (12) and desiccant liner (13).

DESCRIPTION OF THE PREFERRED EMBODIMENT

Turning to the drawings, there is shown the weatherproof multiple padlock enclosure. The apparatus comprises a case body (1), case cover (2), two donut shaped gaskets (3), a cable (4) with looped ends (6), a two section gasket (5), a security loop (10) and desiccant liner (13).

As shown in the drawings the apparatus is used in combination with a fence gate (9) or other closure.

The case body (1) and case cover (2) are sized and shaped to form an enclosure large enough to house at least one padlock (8) and both looped ends (6) of the cable (4). The purpose of the invention is to provide a weatherproof enclosure for one or more padlocks (8) that are being used to secure a fence gate or other closure. The space for more than one padlock is provided because it is sometimes necessary to have several padlock hasps (7) joined in series as chain links in order that any one of the padlocks may be unlocked to open the fence gate. The use or multiple padlocks may be necessitated due to the number of keys or combinations available. It is also possible that two or more padlocks may be used in parallel thereby requiring that all of the padlocks be unlocked in order that the fence gate may be opened.

The donut shaped gaskets (3) are made of resilient material and are each frictionally secured to the cable (4) allowing for adjustment as to the exact position on the cable that is desired. The case body and case cover each have notched out areas with channels (11). As the case cover is closed over the case body the gaskets are slightly compressed forming a weatherproof seal at the notched out areas.

A gasket (5) made of resilient material in two sections is sized and shaped to fit within the channels that have been provided in the case body and case cover where the two would make contact. The channel is sized and shaped in order that the gaskets are slightly compressed thereby forming in conjunction with the donut shaped gaskets a continuous weatherproof seal. Once closed, the apparatus has no openings that would allow moisture to enter. The apparatus includes a desiccant liner (13) that eliminates moisture from the air within the enclosure thereby preventing moisture buildup and resulting corrosion to the padlocks.

A security loop (10) is positioned on the case body of the apparatus in order that the apparatus will remain in combination with the cable even when in an open position.

The case body and case cover may be held together at one dimension by a hinge means to allow for a first open position and a second closed position.

In order to secure the case body and case cover in a closed position a locking means being an interacting latch L may be used.

From the foregoing description it will be apparent that modifications can be made to the apparatus without departing from the teaching of the present invention. Accordingly, it is distinctly understood that the invention is not limited to the preferred embodiment but may be embodied and practiced within the scope of the following claims.

I claim the following:

1. An improved apparatus to more efficiently provide a weatherproof enclosure for padlocks, used to secure a fence gate, said padlocks each having a hasp, said apparatus comprising:

a) a case body in the shape of a topless container with a bottom surface, a front surface, a rear surface and two side surfaces having a case body lip at the point where a top would appear, said case body lip forming a continuous rectangular case body opening having a case body channel appearing along the complete circumference of said rectangular case body opening, in addition said case body lip has two semicircular case body notches one at each side surface of said case body, b) a case cover in the shape of an inverted bottomless container with a top surface, a front surface, a rear surface and two side surfaces, having a case cover lip at the point where a bottom would appear, said case cover lip forming a continuous rectangular case cover opening and having a case cover channel appearing along the complete circumference of said rectangular case cover opening, in addition said case cover lip has two semicircular case cover notches one at each side surface of said case cover, said case cover lip sized and shaped to conform to the dimensions of said case body lip when the said case cover is placed on top of said case body, c) a cable having two looped ends being a first looped end and a second looped end, said looped ends being sized and shaped to receive at least one of said padlock hasps, d) two donut shaped resilient gaskets each having two outer diameter areas, two inner diameter areas and a middle diameter area, each donut shaped resilient gasket appearing to be three donut shaped gaskets, the outer diameter areas having a greater diameter than the diameter of the inner diameter areas and the middle diameter area, the middle diameter area having a greater diameter than the diameter of the inner diameter areas, said donut shaped resilient gaskets having an opening sized and shaped to cause the cable to fit securely within the opening, further the two inner diameter areas being sized and shaped to fit securely against the semicircular case body notches and semicircular case cover notches, further said middle diameter area being sized and shaped to compressibly fit within the channel of both the case body and case cover when said case cover is placed on top of said case body, c) a first section and second section of a resilient gasket sized and shaped to fit frictionally within said case body channel extending between the two semicircular case body notches, and further being sized and shaped in order that the first section and second section of said resilient gasket protrude sufficiently to make compressed contact with the case cover channel and against the two donut shaped resilient gaskets when the case cover is placed on top of said case body, and f) a hinged means for securing the rear surface of the case cover lip of said case cover with the rear surface of the case body lip of said case body, said hinged means being a hinge mechanism affording the case cover to be in a first open position and a second closed position together with an interacting latch to hold the case cover in the second closed position, the securing means when securing the case cover in the second closed position causes the case cover to compress the two section resilient gasket and the two donut shaped resilient gaskets causing a weatherproof seal.

2. Method for enclosing padlocks, used to secure a fence gate, in a weatherproof enclosure, said padlocks each having a hasp, comprising the steps of:

a) positioning a fence with gate around an area, (b) assembling a weatherproof multiple padlock case and cover means being;

(i) a case body in the shape of a topless container with a bottom surface, a front surface, a rear surface and two side surfaces having a case body lip at the point where a top would appear, said case body lip forming a continuous rectangular case body opening having a case body channel appearing along the complete circumference of said rectangular case body opening, in addition said case body lip has two semicircular case body notches one at each side surface of said case body, (ii) a case cover in the shape of an inverted bottomless container with a top surface, a front surface, a rear surface and two side surfaces, having a case cover lip at the point where a bottom would appear, said case cover lip forming a continuous rectangular case cover opening and having a case cover channel appearing along the complete circumference of said rectangular case cover opening in addition said case cover lip has two semicircular case cover notches one at each side surface of said case cover, said case cover lip sized and shaped to conform to the dimensions of said case body lip when the said case cover is placed on top of said case body, (iii) a cable having two looped ends being a first looped end and a second looped end, said looped ends being sized and shaped to receive at least one of said padlock hasps, (iv) two donut shaped resilient gaskets each having two outer diameter areas, two inner diameter areas and a middle diameter area, each donut shaped resilient gasket appearing to be three donut shaped gaskets, the outer diameter areas having a greater diameter than the diameter of the inner diameter areas and the middle diameter area, the middle diameter area having a greater diameter than the diameter of the inner diameter areas, said donut shaped resilient gaskets having an opening sized and shaped to cause the cable to fit securely within the opening, further the two inner diameter areas being sized and shaped to fit securely against the semicircular case body notches and semicircular case cover notches, further said middle diameter area being sized and shaped to compressibly fit within the channel of both the case body and case cover when said case cover is placed on top of said case body, (v) a first section and second section of a resilient gasket sized and shaped to fit frictionally within said case body channel extending between the two semicircular case body notches, and further being sized and shaped in order that the first section and second section of said resilient gasket protrude sufficiently to make compressed contact with the case cover channel and against the two donut shaped resilient gaskets when the case cover is placed on top of said case body, and (vi) a hinged means for securing the rear surface of the case cover lip of said case cover with the rear surface of the case body lip of said case body, said hinged means being a hinge mechanism affording the case cover to be in a first open position and a second closed position together with an interacting latch to hold the case cover in the second closed position, the securing means when securing the case cover in the second closed position causes the case cover to compress the two section resilient gasket and the two donut shaped resilient gaskets causing a weatherproof seal, c) positioning the two donut shaped resilient gaskets on the cable, d) positioning the cable around the fence gate, e) adjusting the position of the two donut shaped resilient gaskets on the cable in order that they fit securely against the semicircular case body notches with the case cover in a first open position, f) securing at least one padlock hasp to the two looped ends of the cable with all padlocks positioned within the continuous rectangular case body opening, g) positioning the case cover in the second closed position forming a weatherproof seal, and h) positioning the interacting latch to hold the case cover in the second closed position.

* * * * *